US005503734A

United States Patent [19]

Fletcher et al.

[11] Patent Number: 5,503,734

[45] **Date of Patent: *Apr. 2, 1996**

[54] HYDROCARBON UPGRADING PROCESS

[75] Inventors: David L. Fletcher, Turnersville; Michael S. Sarli, Haddonfield; Stuart S. Shih, Cherry Hill, all of N.J.

[73] Assignee: Mobil Oil Corporation, Fairfax, Va.

[ * ] Notice: The term of this patent shall not extend beyond the expiration date of Pat. No. 5,413,697.

[21] Appl. No.: 367,670

[22] Filed: Dec. 30, 1994

Related U.S. Application Data

[63] Continuation of Ser. No. 949,926, Sep. 24, 1992, abandoned, which is a continuation-in-part of Ser. No. 850,106, Mar. 12, 1992, Pat. No. 5,409,596, which is a continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/212; 208/211; 208/213; 208/58

[58] Field of Search ..... 208/89, 211, 213, 208/58

[56] References Cited

U.S. PATENT DOCUMENTS

| | | | |
|---|---|---|---|
| 3,767,568 | 10/1976 | Chen . | |
| 3,769,202 | 10/1973 | Plank et al. . | |
| 3,923,641 | 12/1975 | Morrison . | |
| 3,957,625 | 5/1976 | Orkin | 208/211 |
| 4,049,542 | 9/1977 | Gibson et al. . | |
| 4,062,762 | 12/1977 | Howard et al. . | |
| 4,309,280 | 1/1982 | Rosinski et al. | 208/120 M C |
| 4,368,114 | 1/1983 | Chester et al. | 208/120 M C |
| 4,738,766 | 4/1988 | Fischer et al. . | |
| 4,753,720 | 6/1988 | Morrison | 208/135 |
| 4,827,076 | 5/1989 | Kotayeff et al. | 585/737 |
| 5,143,596 | 9/1992 | Maxwell et al. . | |

*Primary Examiner*—Helane Myers
*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha by hydrodesulfurization followed by treatment over an acidic catalyst, preferably a catalyst comprising an intermediate pore size zeolite, such as ZSM-5, and a large pore size zeolite, including a metal hydrogenation function, such as a faujasite, preferably USY, which contains nickel and molybdenum. The treatment over the acidic catalyst in the second step restores the octane loss which takes place as a result of the hydrogenative treatment and results in a low sulfur gasoline product with an octane number comparable to that of the feed naphtha. Use of the intermediate pore size zeolite and the large pore size zeolite is expected to provide more boiling point conversion than either zeolite alone under the same conditions.

50 Claims, No Drawings

HYDROCARBON UPGRADING PROCESS

CROSS REFERENCE TO RELATED APPLICATIONS

This application is a file-wrapper-continuation of our prior application Ser. No. 07/949,926 filed on Sep. 24, 1992, now abandoned which is a continuation-in-part of our prior application Ser. No. 07/850,106 filed on 12 March 1992 now U.S. Pat. No. 5,409,596 which is a continuation-in-part of Ser. No. 07/745,311 filed on 15 August 1991 now U.S. Pat. No. 5,346,609, issued Sep. 13, 1994. This application related application Ser. No. 07/ filed Aug. 17, 1992 now abandoned. These applications are incorporated herein by reference in their entireties.

FIELD OF THE INVENTION

This invention relates to a process for the upgrading of hydrocarbon streams. It more particularly refers to a process for upgrading gasoline boiling range petroleum fractions containing substantial proportions of sulfur impurities. The process involves integration of a first stage hydrotreating of a sulfur-containing cracked petroleum fraction in the gasoline boiling range and a second stage conversion of the hydrotreated intermediate product over a catalyst comprising an intermediate pore zeolite and a large pore size zeolite.

BACKGROUND OF THE INVENTION

Catalytically cracked gasoline forms a major part of the gasoline product pool in the United States. It is conventional to recover the product of catalytic cracking and to fractionate the product into various fractions such as light gases; naphtha, including light and heavy gasoline; distillate fractions, such as heating oil and Diesel fuel; lube oil base fractions; and heavier fractions.

A large proportion of the sulfur in gasoline results from the catalytically cracked gasoline component due to the sulfur content of the petroleum fractions being catalytically cracked. The sulfur impurities may require removal, usually by hydrotreating, in order to comply with product specifications or to ensure compliance with environmental regulations both of which are expected to become more stringent in the future, possibly permitting no more than about 300 ppmw sulfur in motor gasolines. Low sulfur levels result in reduced emissions of CO, $NO_x$ and hydrocarbons.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After completion of hydrotreating, the product may be fractionated, or flashed, to release the hydrogen sulfide and collect the sweetened gasoline.

However, cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Proposals have been made for removing sulfur impurities while retaining the high octane contributed by the olefins. Since the sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. Alternatively, the selectivity for hydrodesulfurization relative to olefin saturation may be shifted by suitable catalyst selection, for example, by the use of a magnesium oxide support instead of the more conventional alumina. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a tension between the growing need to produce gasoline fuels with higher octane number and— because of current ecological considerations— the need to produce cleaner burning, less polluting fuels, especially low sulfur fuels. This inherent tension is yet more marked in the current supply situation for low sulfur, sweet crudes.

Other processes for enhancing the octane rating of catalytically cracked gasolines have also been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

Other methods have been proposed for increasing the octane number of the gasoline pool. Naphthas, including light and full range naphthas, may be subjected to catalytic reforming so as to increase their octane numbers by converting at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Thus, naphthas are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components. Light and full range naphthas can contribute a substantial volume to the gasoline pool, but they do not generally contribute significantly to higher octane values without reforming.

We have demonstrated in our prior co-pending applications Ser. No. 07/850,106, filed on Mar. 12, 1992 and Ser. No. 07/745,311 filed on Aug. 15, 1991 that zeolite ZSM-5 is effective for restoring the octane loss which takes place when the initial naphtha feed is hydrotreated. When the hydrotreated naphtha is passed over the catalyst in the second step of the process, some components of the gasoline are cracked into lower boiling range materials. If these boil below the gasoline boiling range, there will be a loss in the yield of the gasoline product. However, if the cracked products are within the gasoline boiling range, an increase occurs in the net volumetric yield. To achieve this, it is helpful to increase the end point of the naphtha feed to the extent that this will not result in exceeding the gasoline product end point, or similar restrictions (e.g. $T_{90}$, $T_{95}$).

SUMMARY OF THE INVENTION

We have now found a process for catalytically desulfurizing cracked fractions in the gasoline boiling range which enables the sulfur to be reduced to acceptable levels without substantially reducing the octane number. In favorable cases, the volumetric yield of gasoline boiling range product is not substantially reduced and may even be increased so that the number of octane barrels of product produced is at least equivalent to the number of octane barrels of feed introduced into the operation.

The process may be utilized to desulfurize light and full range naphtha fractions while maintaining octane so as to obviate the need for reforming such fractions, or at least, without the necessity of reforming such fractions to the degree previously considered necessary. Since reforming generally implies a significant yield loss, this constitutes a marked advantage of the present process.

The process of the invention is based upon a catalyst system which contains at least two cracking components in which each component contributes a distinct performance advantage to the process. The catalyst system comprises a large pore size crystalline zeolite and a smaller pore size crystalline zeolite. The combination of zeolites is expected to give a greater boiling point conversion than either zeolite alone.

According to the present invention, a sulfur-containing cracked petroleum fraction in the gasoline boiling range is hydrotreated, in a first stage, under conditions which remove at least a substantial proportion of the sulfur. The hydrotreated intermediate product is then treated, in a second stage, by contact with a catalyst system which comprises an intermediate pore size zeolite and a large pore size zeolite in the presence of at least one hydrogenation component under conditions which convert the hydrotreated intermediate product fraction to a fraction in the gasoline boiling range of higher octane value.

For purposes of this invention, the terms "first step" and "first stage" are used interchangeably to refer to the first reaction zone in which hydrotreating is the prevailing reaction. The term "hydrotreating" is used as a general process term descriptive of the reactions of the first reaction zone in which a prevailing degree of hydrodesulfurization occurs. The terms "second step" and "second stage" are used interchangeably to refer to the second reaction zone in which hydrocarbon cracking reactions prevail.

DETAILED DESCRIPTION

Feed

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F. (163° C.) and preferably at least about 350° F. (177° C.), for example, 95 percent points of at least 380° F. (about 193° C.) or at least about 400° F. (about 220° C.).

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F. (93° C.) to about 300° F. (150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F. (65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F. (82° C). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

The following Table 1 sets forth the composition of a naphtha feed of the kind which would be treated in accordance with this invention.

TABLE 1

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, ASTM D-2887, | °F./°C. |
| 5% | 289/143 |
| 10% | 355/179 |
| 30% | 405/207 |
| 50% | 435/223 |
| 70% | 455/235 |
| 90% | 482/250 |
| 95% | 488/253 |

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

This hydrotreated intermediate product which also boils in the gasoline boiling range (and usually has a boiling range which is not substantially higher than the boiling range of the feed), is then treated by contact with an acidic catalyst system under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable octane rating as the result of the second stage treatment.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$), usually about 1000 to 2500 SCF/B (about 180 to 445 $n.l.l^{-1}$). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

A change in the volume of gasoline boiling range material typically takes place in the first step. Although some decrease in volume occurs as the result of the conversion to lower boiling products ($C_5$–), the conversion to $C_5$– products is typically not more than 5 volume percent and usually below 3 volume percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5$+) materials may occur.

Octane Restoration—Second Step Processing

After the hydrotreating step, the hydrotreated intermediate product is passed to the second step of the process in which cracking takes place in the presence of the acidic functioning catalyst. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

Another process configuration with potential advantages is to take a heart cut, for example, a 195°–302° F. (90°–150° C.) fraction, from the first stage product and send it to the reformer where the low octane naphthenes which make up a significant portion of this fraction are converted to high octane aromatics. The heavy portion of the first stage effluent is, however, sent to the second step for restoration of lost octane by treatment with the acid catalyst system. The hydrotreatment in the first stage is effective to desulfurize and denitrogenate the catalytically cracked naphtha which permits the heart cut to be processed in the reformer. Thus, the preferred configuration in this alternative is for the second stage to process the $C_8$+ portion of the first stage effluent and with feeds which contain significant amounts of heavy components up to about $C_{13}$ e.g. with $C_9$–$C_{13}$ fractions going to the second stage, improvements in both octane and yield can be expected.

The conditions used in the second step of the process are those which result in a controlled degree of partial shape-selective cracking of the low octane paraffinic components of the desulfurized, hydrotreated effluent from the first step to restore the octane rating of the original, cracked feed at least to a partial degree. The reactions which take place over the intermediate pore size zeolite during the second step are shape-selective cracking of low octane paraffins to form higher octane products, both by the selective cracking of heavy paraffins to lighter paraffins and the less shape selective cracking over the large pore size zeolite to convert the bulkier highly branched long chain paraffins, olefins and cyclics with the generation of olefins. Some isomerization of n-paraffins to branched-chain paraffins of higher octane may take place, making a further contribution to the octane of the final product. In addition, the large pore zeolite will preferentially adsorb the higher molecular weight alkyl benzenes and two-ring aromatics and convert them to lower boiling point, higher octane aromatics. In favorable cases, the original octane rating of the feed may be completely restored or perhaps even exceeded. Since the volume of the second stage product will typically be comparable to that of the original feed or even exceed it, the number of octane barrels (octane rating x volume) of the final, desulfurized product may exceed the octane barrels of the feed.

Two configurations in the octane restoration zone are contemplated.

In a first embodiment, the octane restoration zone is made of two distinct catalyst layers in which the first layer comprises the large pore zeolite and a metal hydrogenation component. The next layer comprises the intermediate pore size component. This configuration is intended to preserve potential for $C_3$ and $C_4$ olefins production which can, potentially, be utilized in an alkylation unit to achieve an overall refinery octane boost. However, the olefins and $H_2S$ are expected to make mercaptans which would require post-treatment for their removal. In this embodiment, the preferred large pore zeolite and hydrogenation component will be prepared as described in U.S. Pat. No. 4,676,887 which is incorporated herein by reference.

In a second embodiment, the octane restoration zone comprises a physical mixture of the two zeolite components and the metal hydrogenation function. This is intended to saturate olefins to avoid recombination with $H_2S$ which would produce mercaptans. However, in this alternative the possibility for making $C_3$ and $C_4$ olefins is substantially reduced which would decrease the possibility for an overall refinery octane increase. The preferred catalyst for this embodiment will include about 30% alumina binder, 35% ZSM-5 or HZSM-5 and 35% USY 24.30 to 24.24 UCS. This catalyst is impregnated with a metal hydrogenation function, in proportion to the large pore zeolite, such as USY.

The choice between the above process configurations will depend on the quality of the feed, specific refinery application and economic considerations.

The conditions used in the second step are those which are appropriate to produce this controlled degree of cracking. Typically, the temperature of the second step will be about 300° to 900° F. (about 150° to 480° C.), preferably about 350° to 800° F. (about 177° to 426° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner.

The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios will be higher than used in the absence of the large pore zeolite component, typically of about 500 to 5000 SCF/Bbl (0 to 890 $n.l.l^{-1}$.), preferably about 1000 to 2500 SCF/Bbl (about 18 to 445 $n.l.l^{-1}$.) and will be selected to minimize catalyst aging.

In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$–) during the second stage is held to a minimum. However, because the cracking of the heavier portions of the feed may lead to the production of products still within the gasoline range a net increase in the gasoline range material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

SECOND STAGE CATALYST

The catalyst used in the second step of the process possesses sufficient acidic functionality to bring about the desired cracking reactions to restore the octane lost in the hydrotreating step. The contemplated catalysts for this purpose are those which contain an intermediate pore size zeolitic behaving catalytic material which is exemplified by those acid acting materials having the topology of intermediate pore size aluminosilicate zeolites and large pore size zeolites and a metal hydrogenation component.

The hydrogenation functionality is provided by a metal component selected from Group VIA or Group VIIIA of the Periodic Table of the Elements. The metal component comprises at least one metal which is nickel, tungsten, vanadium, molybdenum, cobalt or chromium. The metal component can also comprise at least one metal which is platinum or palladium. In another embodiment, the hydrogenation component is tungsten, vanadium, zinc, molybdenum, rhenium, nickel, cobalt, chromium, manganese, platinum, palladium and mixtures thereof.

The intermediate pore size zeolitic materials are exemplified by those which, in their aluminosilicate form would have a Constraint Index between about 2 and 12. The preferred intermediate pore size zeolite is an aluminosilicate having the topology of ZSM-5. ZSM-5 is described in U.S. Pat. No. 3,702,886 which is incorporated herein by reference in its entirety.

The large pore size zeolitic behaving materials are exemplified by those acid acting materials having the topology of large pore size aluminosilicate zeolites. These zeolitic materials are exemplified by those which in their aluminosilicate form have a Constraint Index less than about 2. The aromatic shape selective large pore size zeolites such as zeolites X and Y are preferred in order to effect the desired conversion of the highly aromatic feeds to produce the high octane gasoline product. The paraffin selective zeolite beta is also contemplated where it is necessary to crack paraffins.

In one embodiment of the invention, the large pore size zeolite is associated with a a Group VIIIA metal and/or a Group VIA metal, of the "Periodic Table of the Elements", Sargent-Welch Scientific Company (1980) and, preferably, a binder or a matrix material. More specifically, the amount of the Group VIII metal is controlled so that it is present in the catalyst composition in an amount which is directly proportional to the zeolitic framework aluminum contained in the large pore zeolite. In this embodiment of the invention, the large pore zeolite is, typically, ultrastable Y.

As the large pore and intermediate pore zeolite components are more broadly defined by the Constraint Index, reference is made to U.S. Pat. No. 4,784,745 for a definition of Constraint Index and a description of how this value is measured. This patent also discloses a substantial number of catalytic materials having the appropriate topology and the pore structure to be useful in this service.

The following Table sets forth the Constraint Index (C.I.) Values for some of these large pore zeolites:

| Zeolite | C.I. |
|---|---|
| Beta | 0.6 |
| ZSM-4 | 0.5 |
| H-Zeolon | 0.5 |
| Acid Mordenite | 0.5 |
| REY | 0.4 |
| Amorphous Silica-Alumina | 0.6 |

The large pore materials are characterized by a pore size larger than about 7 Angstrom units, preferably greater than 8 Angstrom units, which have the ability to admit and act upon substantially all the components found in the feedstock, including the very bulky, highly branched and aromatic larger molecules. Zeolites of this type include mordenite, zeolite beta, ZSM-20, faujasites such as zeolite Y, USY or REY, and ZSM-4. Reference is made to the U.S. Pat. No 3,308,069 and U.S. Pat. No. Re. 28,341 for a description of zeolite beta, U.S. Pat. No. 3,972,983 for a description of ZSM-20 and U.S. Pat. No. 3,578,723 for a description of ZSM-4, all of which are incorporated herein by reference in their entireties. Representative examples of other large pore materials which can be combined with ZSM-5 to produce satisfactory results include the synthetic faujasite X, zeolite L, naturally occurring zeolites such as chabazite, faujasite, mordenite and the like.

As mentioned previously, the large pore zeolite is associated with a metal component(s) which provides hydrogenation-dehydrogenation functionality. Suitable hydrogenation components include at least one metal of Group VI and at least one metal of Group VIII such as tungsten, molybdenum, nickel, cobalt, chromium, in an amount between 0.5 and about 25 wt %, normally 1 to 20 wt %, and preferably 1 to 10 wt %. Preferably, the combined weight of the Group VIII metal and Group VI metal is 3 to 15 weight percent of the catalyst. The most preferred Group VIII metals include nickel and cobalt, while the most preferred Group VI metals include tungsten and molybdenum. Accordingly, metal components, especially nickel-tungsten and nickel-molybdenum, cobalt-tungsten and cobalt-molybdenum are particularly preferred in the present invention. These components can be exchanged or impregnated into the composition or added via other methods well known to those skilled in the art, using suitable compounds of the metals. The compounds used for incorporating the metal component into the catalyst can usually be divided into compounds in which the metal is present in the cation of the compound or compounds in which it is present in the anion of the compound. Compounds which contain the metal as a neutral complex may also be employed. The compounds which contain the metal in the ionic state are generally used. For a description of the large pore zeolite catalyst composition, reference is made to U.S. Pat. application, Ser. No. 07/629,952 which is incorporated herein by reference in its entirety.

The original cations associated with, for example, crystalline ultrastable Y, may be replaced by the cations, according to conventional techniques. Typical replacing cations including hydrogen, ammonium and metal cations, including mixtures of these cations. Typical ion-exchange techniques are to contact the particular zeolite with a salt of the desired replacing cation. Although a wide variety of salts can be employed, particular preference is given to chlorides, nitrates and sulfates. Representative ion-exchange techniques are disclosed in a wide variety of patents, including U.S. Pat. Nos. 3,140,249; 3,140,251; and 3,140,253.

Following contact with a solution of the desired replacing cation, the zeolite containing catalyst is then preferably washed with water and dried at a temperature ranging from 150° to about 600° F. (65°–315° C.), and thereafter calcined in air, or other inert gas, at temperatures ranging from about 500° to 1500° F. (260°–815° C.) for periods of time ranging from 1 to 48 hours or more.

In accordance with the invention, the Group VIII metal is present in the composition in an amount directly proportional to the framework aluminum content of the zeolite, i.e. ultrastable Y. For example, the ultrastable Y has a silica:alumina framework molar ratio exceeding about 5. It has been found that useful catalysts for this process have controlled metal/acid ratios and this can be described by the ratio of Group VIII metal to the zeolite framework Al content. The molar ratio of Group VIII metal:framework aluminum (provided by the ultrastable Y), in the catalyst of the invention, is less than 2. Generally, that ratio ranges from 0 to 1. Preferably, the Group VIII metal:framework aluminum ratio (provided by the ultrastable Y), in the catalyst of the invention, ranges from 0.1 to 0.8. The parameter of Group VIII metal:framework aluminum ratio (provided by the ultrastable Y), in the catalyst of the invention, can maximize catalytic conversion to high octane gasoline.

Preferably, as mentioned previously, the catalyst composition includes a matrix comprising another material, other than the large pore zeolite, exemplified by ultrastable Y, resistant to the temperature and other conditions employed in the process. The matrix material is useful as a binder and imparts greater resistance to the catalyst for the severe temperature, pressure and reactant feed stream velocity conditions encountered in the process. Useful matrix materials include both synthetic and naturally occurring substances, such as clay, silica, alumina, silica-alumina, zirconia and/or metal oxides. The latter may be either naturally occurring or in the form of synthetic gelatinous precipitates or gels including mixtures of silica and metal oxides such as alumina and silica-alumina. The matrix may be in the form of a cogel. Naturally occurring clays which can be composited with the zeolite include those of the montmorillonite and kaolin families. Such clays can be used in the raw state as originally mined or initially subjected to calcination, acid treatment or chemical modification. The relative proportions of zeolite component and the matrix, on an anhydrous basis, may vary widely with the zeolite content ranging from between about 1 to about 99 wt %, and more usually in the range of about 5 to about 80 wt % of the dry composite. The binder is preferably composited with the zeolite prior to treatments such as steaming, impregnation, exchange, etc., in order to preserve mechanical integrity.

The zeolite designations used here are exemplary of the topology and pore structure of suitable acid-acting refractory solids; however, useful catalysts are not confined to the aluminosilicates and other refractory solid materials which have the desired acid activity, pore structure and topology may also be used. The framework is principally silicon tetrahedrally coordinated with oxygen bridges. Other framework components, for example, may include Group IIIB and VB elements of the Periodic Table, e.g. aluminum, boron, gallium, iron and phosphorus. The zeolite designations define the topology only and do not restrict the compositions of the zeolitic-behaving catalytic components.

The catalyst should have sufficient acid activity to have cracking activity with respect to the second stage feed (the intermediate fraction). One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in *J. Catalysis,* 61, 395 ( 1980).

The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The zeolites are combined in the catalyst in amounts which may vary depending upon the preferred product composition. The intermediate pore size component facilitates conversion of very low octane components (e.g. n-paraffins) while the large pore size component will crack multi-ring aromatics to higher octane alkyl benzenes. Since under these process conditions the intermediate pore size zeolites exhibit shape selective cracking of paraffinic components and the large pore size zeolites preferentially adsorb the bulkier higher boiling aromatics, the combination provides a more efficient means of effecting the goals or octane number restoration and feed boiling range reduction.

Thus, the zeolites can be present in about equal amounts in order to achieve a balance in the properties that each will contribute to the overall process. However, the relative proportion of the intermediate pore size component can be lower than the large pore component such that it is used in additive amounts.

The catalyst system can comprise a physical mixture of the zeolite components or a single particle catalyst with two zeolites in a binder.

When practicing the process of the invention, it may be useful to incorporate each zeolite or the combined zeolites with a matrix comprising another material resistant to the temperature and other conditions employed in the process. Such matrix material is useful as a binder and imparts greater resistance to the catalyst for the severe temperature, pressure and reactant feedstream velocity conditions encountered in, for example, many cracking processes. Also, the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica and/or metal oxides. These may be either naturally occurring or in the form of gelatinous precipitates or gels including mixtures of silica and metal oxides. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is haloysite, kaolinite, dickite, nacrite or anauxite. Such clays can be used in the raw state as originally mined or initially subjected to calcination, acid treatment or chemical modification.

In addition to the foregoing materials, the zeolites employed herein, as previously described with respect to the large pore zeolite, may be composited with a porous matrix material such as alumina, silica-alumina, silica-zirconia, silica-thoria, silica-titania, titania or zirconia. The matrix may be in the form of a cogel. The relative proportions of zeolite component and inorganic oxide gel matrix, on an anhydrous basis, may vary widely with the zeolite component and inorganic oxide gel matrix, on an anhydrous basis, may vary widely with the zeolite content ranging from between about 1 to about 99 wt. %, and more usually in the range of about 5 to about 80 wt. % of the dry composite.

The original cations associated with each of the crystalline silicate zeolites utilized herein may be replaced by a wide variety of other cations, according to techniques known in the art. Typical replacing cations including hydrogen, ammonium, alkyl ammonium and metal cations, including mixtures of the same. Of the replacing metallic cations, which are discussed more fully hereinafter, particular preference is given to base metal sulfides, such as nickel-tungsten or nickel molybdenum. These metals are believed to be advantageous in providing higher octane gasolines when operating at the higher end of the pressure regime. Other cations include metals such as rare earth metals, e.g., manganese, as well as metals of Group IIA and B of the Periodic Table, e.g. zinc, and Group VIII of the Periodic Table, e.g. platinum and palladium.

In the process of making the zeolite composites, following contact with a solution of of the desired replacing cation, the zeolite is then preferably washed with water and dried at a temperature ranging from 150° F. to about 600° F. (65° C. to 315° C.), and thereafter calcined in air or other inert gas, at temperatures ranging from about 500° F. to 1500° F. (260° C. to 815° C.) for periods of time ranging from 1 to 48 hours or more. It has been further found that catalysts of improved selectivity and other beneficial properties may be obtained by subjecting the zeolite to treatment with steam at elevated temperatures ranging from 500° F. to 1200° F. (399° C. to 538° C) and preferably 750° F. 1000° F. (260° C. to 694° C.). The treatment may be accomplished in an atmosphere of 100% steam or an atmosphere consisting of steam and a gas which is substantially inert to the zeolites. A similar treatment can be accomplished at lower temperatures and elevated pressure, e.g. 350° F. to 700° F. (177° C. to 371° C) at 10 to about 200 atmospheres.

Both zeolite components need not be mixed with the same matrix. Each can be incorporated into its own separate binder and the intermediate pore-containing composite material can be blended with the large pore-containing composite material. The catalyst composites can be used in a physical mixture in the bed or the catalyst bed can be made of layers of each catalyst composite.

The catalyst composite can be prepared by mechanically mixing together the zeolites to produce a catalyst composition which comprises a mixture of discrete crystallites of the intermediate pore and the large pore component. The zeolites can be mixed and then a suitable hydrogenation component can be deposited on at least the large pore size zeolite by conventional impregnation techniques, either before, after or during mixing. Alternatively the zeolites and hydrogenation function can be in a single extrudate catalyst.

The octane efficiency of the process; that is, the octane gain relative to the yield loss will vary according to a number of factors, including the nature of the feedstock, the conversion level and the relative proportions and activities of the catalysts. It may be useful to vary the amount of each zeolite distributed throughout the bed. That is, it may be preferred to place more large pore zeolites, i.e. 4, towards the top of the bed for maximum conversion of the heavier hydrocarbons to lighter hydrocarbons which can be handled by the intermediate pore catalyst located downstream. In this manner, optimum efficiency of the intermediate pore size zeolite for octane gain may be achieved. Alternatively, a 2-bed reactor may be employed in which the large pore size zeolite and metal hydrogenation component are located entirely in the first bed and the intermediate pore size zeolite is located downstream in a second bed.

The particle size and the nature of the second conversion catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the fixed-bed type of operation preferred.

PRODUCT OPTIMIZATION

The conditions of operation and the catalysts should be selected, together with appropriate feed characteristics to result in a product slate in which the gasoline product octane is not substantially lower than the octane of the feed gasoline boiling range material; that is, not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus, the second zone may be operated at higher temperature and lower pressure than the first zone in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the second step of the process are particularly suitable for this purpose since they are more olefinic than the comparable but saturated fraction from the hydrotreating step. Alternatively, the olefinic light ends from the second step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some and preferably a substantial proportion, to high octane alkylate in the gasoline boiling range, to increase both the octane and the volumetric yield of the total gasoline product.

In this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the olefin content is high in the feed, that this octane reduction could go as high as about 15%.

The second stage of the process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

EXAMPLE 1

In this example, a heavy naphtha derived from a Fluid Catalytic Cracker was treated in a two stage process to remove sulfur and restore octane using an intermediate pore zeolite, and limiting boiling range conversion. Properties of the naphtha are shown in Table 1.

TABLE 1

| Heavy FCC Naphtha Properties | | |
|---|---|---|
| Gravity, API | 23.5 | |
| Hydrogen, wt % | 10.23 | |
| Sulfur, wt % | 2.0 | |
| Nitrogen, ppmw | 190 | |
| Clear Research Octane | 95.6 | |
| Distillation, °F. | ASTM D2887 | ASTM D86 |
| IBP | 131 | 212 |
| 5% | 289 | 382 |
| 10% | 335 | 396 |
| 30% | 405 | 418 |
| 50% | 435 | 432 |
| 70% | 453 | 444 |
| 90% | 482 | 464 |
| 95% | 488 | 474 |
| EP | 529 | 497 |

A conventional cobalt-molybdenum hydrotreating catalyst was used in the first stage while a ZSM-5 catalyst was used in the second stage to restore octane through cracking reactions. The properties of the catalysts are shown in Table 2.

TABLE 2

| | Catalyst Properties | |
|---|---|---|
| Composition, wt % | Hydrodesulfurization 1st Stage Catalyst | ZSM-5[1] 2nd Stage Catalyst |
| Nickel | — | 1.0 |

TABLE 2-continued

| | Catalyst Properties | |
|---|---|---|
| Composition, wt % | Hydrodesulfurization 1st Stage Catalyst | ZSM-5[1] 2nd Stage Catalyst |
| Cobalt | 3.4 | — |
| MoO3 | 15.3 | — |
| Physical Properties | | |
| Particle Density, g/cc | — | 0.98 |
| Surface Area, $m^2/g$ | 260 | 336 |
| Pore Volume, cc/g | 0.55 | 0.65 |
| Pore Diameter, A | 85 | 77 |

[1]Contains 65 wt % ZSM-5 and 35 wt % alumina.

Both stages of the process were carried out in an isothermal pilot plant with direct cascade of the first stage effluent to the second stage. The ratio of catalyst volumes used in the first and second stages was 1:2 by volume.

The following conditions of operation were maintained: 0.84 LHSV, 3200 SCF/BBL hydrogen, 600 psig, Reactor 1 at 698° F., Reactor 2 at 751° F. Product properties and yields are shown in Table 3.

TABLE 3

| Hydrodesulfurization and ZSM-5 Upgrading of Heavy FCC Naphtha | | |
|---|---|---|
| | Reactor 1 Hydrodesulfurization | Reactor 2 ZSM-5 Upgrading |
| Properties | | |
| Research Octane | 91.2 | 98.8 |
| Sulfur, ppmw | <100 | <100 |
| Nitrogen, ppmw | 7 | 2 |
| Product Yields, wt % | | |
| Light Gases C4–: | | |
| $C_1$–$C_2$ | 0.0 | 0.6 |
| $C_3$ Olefins | 0.0 | 0.1 |
| $C_3$ Paraffins | 0.0 | 2.3 |
| $C_4$ Olefins | 0.0 | 0.2 |
| $C_4$ Isoparaffins | 0.0 | 2.1 |
| $C_4$ Normal Paraffins | 0.0 | 1.6 |
| Liquid Products C5+: | | |
| Paraffins | 13.0 | 10.7 |
| $C_5$–$C_{11}$ | 2.2 | 10.7 |
| $C_{11}$+ | 10.8 | 0.0 |
| Olefins | 1.9 | 1.4 |
| Naphthenes | 13.7 | 11.5 |
| Aromatics | 70.2 | 68.4 |
| One Ring | 30.4 | 32.3 |
| Two Ring | 39.8 | 36.1 |
| Gasoline Yield, wt %: | | |
| $C_5$-400° F. | 30 | 43 |

The first hydrodesulfurization stage removed most of the sulfur, but a large octane loss occurred due to olefin saturation. The second cracking stage restored the octane by selectively cracking low octane paraffins, and generating olefins. The preferential cracking of heavy $C_{11}$+ paraffins gives some conversion of heavy naphtha to the $C_5$–400° F. gasoline range. But conversion of >400° F. naphtha is limited, since the large two ring aromatics are less reactive over the ZSM-5 due to the intermediate pore size.

EXAMPLE 2

In this example, a similar heavy naphtha derived from a Fluid Catalytic Cracker was treated over a large pore zeolite for substantial boiling range conversion, producing a desulfurized product, but of lower octane. Properties of the naphtha are shown in Table 4.

TABLE 4

| Heavy FCC Naphtha Properties | | |
|---|---|---|
| Gravity, API | 24.2 | |
| Hydrogen, wt % | 9.87 | |
| Sulfur, wt % | 1.65 | |
| Nitrogen, ppmw | 180 | |
| Clear Research Octane | 96.3 | |
| Distillation, °F. | ASTM D2887 | ASTM D86 |
| IBP | 196 | 247 |
| 5% | 312 | 362 |
| 10% | 335 | 379 |
| 30% | 398 | 406 |
| 50% | 429 | 426 |
| 70% | 453 | 444 |
| 90% | 487 | 471 |
| 95% | 496 | 485 |
| EP | 552 | 510 |

The catalyst was a conventional hydrocracking catalyst obtained from Akzo Chemicals, Inc., Ketjen Catalysts, which contains nickel and molybdenum oxides on an alumina support with a USY zeolite component. The process was carried out in an isothermal pilot plant under the following conditions: 0.9 LHSV, 3200 SCF/BBL Hydrogen, 600 psig, 747° F.

Table 5 shows that the product was desulfurized, but the octane was lower than the feed.

TABLE 5

| NiMo/USY Upgrading Heavy FCC Naphtha | |
|---|---|
| Properties | |
| Research Octane | 92.6 |
| Sulfur (ppmw) | <100 |
| Nitrogen (ppmw) | <20 |
| Product Yields, wt % | |
| Light Gases $C_4$–: | |
| $C_1$–$C_2$ | 1.4 |
| $C_3$ Olefins | 0.0 |
| $C_3$ Paraffins | 3.4 |
| $C_4$ Olefins | 0.0 |
| $C_4$ Isoparaffins | 2.1 |
| $C_4$ Normal Paraffins | 2.7 |
| Liquid Products $C_5$+: | |
| Paraffins | 17.8 |
| $C_5$–$C_{11}$ | 11.4 |
| $C_{11}$+ | 6.4 |
| Olefins | 0.0 |
| Naphthenes | 11.1 |
| Aromatics | 61.7 |
| One Ring | 48.6 |
| Two Ring | 13.1 |
| Gasoline Yield, wt % | |
| $C_5$-400° F. | 59 |

The shape selective cracking of low octane paraffins over ZSM-5 responsible for the octane boost in the first example was limited with the large pore zeolite used in this example. However, two ring aromatics reacted readily since they were not excluded from the internal structure, being strongly adsorbed. Cracking two ring aromatics to achieve lighter alkyl benzenes resulted in a substantial boiling range conversion to $C_5$–400° F. gasoline product.

EXAMPLE 3

In this example, a large pore size zeolite and an intermediate pore size zeolite will be combined in a single process to treat a heavy cracked naphtha, for purposes of achieving high desulfurization with little octane loss and substantial boiling range conversion. The naphtha will be similar to that used in the previous examples. The three stage process will comprise a conventional cobalt-molybdenum hydrotreating catalyst in the first stage, a conventional hydrocracking catalyst containing a large pore zeolite in the second stage, and an intermediate pore zeolite in the third stage. Catalysts such as those described in the above examples will be suitable. The process will be carried out with direct cascade of products from stage-to-stage. The catalyst ratio will follow that of the previous examples with 1:2:1 by volume of stage 1, stage 2, and stage 3 catalysts. Suitable process conditions will be: 0.5 LHSV, 3200 SCF/BBL hydrogen, 600 psig, 700° F. in stage 1, 750° F. in stage 2 and stage 3.

The predicted product properties and yields are presented in Table 6.

TABLE 6

| Predicted Results for Upgrading a Heavy FCC Naphtha with an Intermediate and Large Pore Zeolite | |
|---|---|
| Product Properties | |
| Research Octane | 99 |
| Sulfur (ppmw) | <100 |
| Nitrogen (ppmw) | <20 |
| Product Yields, wt % | |
| Light Gases $C_4$–: | |
| $C_1$–$C_2$ | 2 |
| $C_3$ Olefins | 0 |
| $C_3$ Paraffins | 6 |
| $C_4$ Olefins | 0 |
| $C_4$ Isoparaffins | 4 |
| $C_4$ Normal Paraffins | 4 |
| Liquid Products $C_5$+: | |
| Paraffins | 12 |
| $C_5$-$C_{11}$ | 12 |
| $C_{11}$+ | 0 |
| Olefins | 1 |
| Naphthenes | 9 |
| Aromatics | 62 |
| One Ring | 50 |
| Two Ring | 12 |
| Gasoline Yield, wt % | |
| $C_5$-400° F. | 65 |

The first stage hydrotreating catalyst is expected to provide desulfurization and denitrogenation. The second stage catalyst is expected to crack two ring aromatics to lower boiling alkyl benzenes, while the third stage catalyst is expected to selectively crack low octane paraffins, while preferentially cracking the heavy $C_{11}$+ paraffins to lower boiling paraffins. The second and third cracking stages are expected to act synergistically to obtain a substantial boiling range conversion, while producing a gasoline of higher octane.

We claim:

1. A process of upgrading a sulfur-containing catalytically cracked fraction having a 95% point of at least about 325° F. and boiling in the gasoline boiling range which comprises:

contacting the sulfur-containing catalytically cracked fraction having a 95% point of at least about 325° F. and boiling in the gasoline boiling range with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product in a second reaction zone with a catalyst system having acidic functionality comprising an intermediate pore size zeolite and a large pore size zeolite having a hydrogenation functionality in the presence of hydrogen to effect cracking of heavy paraffins to lighter paraffins and cracking of low octane n-paraffins in the intermediate product to convert it to a product comprising a fraction boiling in the gasoline boiling range having a higher octane number than the gasoline boiling range fraction of the intermediate product.

2. The process as claimed in claim 1 in which the hydrogenation functionality is selected from the group consisting of Group VIA and Group VIIIA of the Periodic Table of the Elements.

3. The process as claimed in claim 1 in which the hydrogenation functionality comprises at least one metal selected from the group consisting of nickel, tungsten, vanadium, molybdenum, cobalt and chromium.

4. The process as claimed in claim 1 in which the hydrogenation functionality comprises at least one metal selected from the group consisting of platinum and palladium.

5. The process as claimed in claim 1 in which the intermediate pore size zeolite has a Constraint Index ranging from 2 to 12.

6. The process as claimed in claim 1 in which the intermediate pore size zeolite has the topology of ZSM-5.

7. The process as claimed in claim 1 in which the large pore size zeolite has a Constraint Index of less than 2.

8. The process as claimed in claim 1 in which the large pore size zeolite has the topology of a faujasite zeolite.

9. The process as claimed in claim 1 in which the large pore size zeolite has the topology of USY, REY or ZSM-20.

10. The process as claimed in claim 1 in which the large pore size zeolite has the topology of zeolite beta.

11. The process as claimed in claim 1 in which the large pore size zeolite of the catalyst system comprises the large pore size zeolite, a group VIIIA metal and a Group VIA metal, in a matrix, wherein the group VIIIA metal is present in an amount such that a ratio of gram atom mole of Group VIIIA metal:mole of framework aluminum of said large pore zeolite is less than 2; wherein the Group VIA metal is present in an amount ranging from 0.5 to 25 percent of the catalyst; and wherein the large pore size zeolite comprises 5 to 80 weight percent of the catalyst system.

12. The process as claimed in claim 11 in which the ratio of gram atom mole of Group VIIIA metal:mole of framework aluminum is 0.1 to 0.8.

13. The process as claimed in claim 11 in which the ratio of gram atom mole of Group VIIIA metal:mole of framework aluminum is 0.25 to 0.5.

14. The process as claimed in claim 11 in which the large pore size zeolite has the topology of a faujasite zeolite.

15. The process as claimed in claim 11 in which the large pore size zeolite has the topology of USY, REY or ZSM-20.

16. The process as claimed in claim 11 in which the large pore size zeolite has the topology of zeolite beta.

17. The process as claimed in claim 11 in which the intermediate pore size zeolite has the topology of ZSM-5.

18. The process as claimed in claim 1 in which the intermediate pore size zeolite is in the aluminosilicate form.

19. The process as claimed in claim 1 in which the large pore size zeolite is in the aluminosilicate form.

20. The process as claimed in claim 1 which is carried out in two stages with an interstage separation of light ends and heavy ends with the heavy ends fed to the second reaction zone.

21. The process as claimed in claim 1 which is carried out in cascade mode with the entire effluent from the first reaction zone passed to the second reaction zone.

22. The process as claimed in claim 1 in which the feed fraction comprises a light naphtha fraction having a boiling range within the range of $C_6$ to 330° F.

23. The process as claimed in claim 1 in which the feed fraction comprises a full range naphtha fraction having a boiling range within the range of $C_5$ to 420° F.

24. The process as claimed in claim 1 in which the feed fraction comprises a heavy naphtha fraction having a boiling range within the range of 330° to 500° F.

25. The process as claimed in claim 1 in which the feed fraction comprises a naphtha fraction having a 95 percent point of at least about 350° F.

26. The process as claimed in claim 1 in which the feed fraction comprises a naphtha fraction having a 95 percent point of at least about 380° F.

27. The process as claimed in claim 1 in which the feed fraction comprises a naphtha fraction having a 95 percent point of at least about 400° F.

28. A process of upgrading a sulfur-containing catalytically cracked, olefinic hydrocarbon naphtha feed fraction boiling in the gasoline boiling range which comprises:

hydrodesulfurizing a catalytically cracked, olefinic, sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product in an octane restoring reaction zone in the presence of hydrogen with a catalyst system having acidic functionality comprising an intermediate pore size zeolite and a large pore size zeolite having at least one hydrogenation functionality to effect cracking of heavy paraffins to light paraffins and cracking of low octane n-paraffins in the intermediate product to convert it to a product comprising a fraction boiling in the gasoline boiling range having a higher octane number than the gasoline boiling range fraction of the intermediate product.

29. The process as claimed in claim 28 in which the hydrogenation functionality is selected from the group consisting of Group VIA and Group VIIIA of the Periodic Table of the Elements.

30. The process as claimed in claim 28 in which the hydrogenation functionality comprises at least one metal selected from the group consisting of nickel, tungsten, vanadium, molybdenum, cobalt and chromium.

31. The process as claimed in claim 28 in which the hydrogenation functionality comprises at least one metal selected from the group consisting of platinum and palladium.

32. The process as claimed in claim 28 in which the large pore size zeolite has a Constraint Index of less than 2.

33. The process as claimed in claim 28 in which the large pore size zeolite has the topology of a faujasite zeolite.

34. The process as claimed in claim 28 in which the large pore size zeolite has the topology of USY, REY or ZSM-20.

35. The process as claimed in claim 28 in which the large pore size zeolite has the topology of zeolite beta.

36. The process as claimed in claim 28 in which the intermediate pore size zeolite has a Constraint Index ranging from 2 to 12.

37. The process as claimed in claim 28 in which the intermediate pore size zeolite has the topology of ZSM-5.

38. The process as claimed in claim 28 in which the large pore size zeolite of the catalyst system comprises the large pore size zeolite, a group VIIIA metal and a Group VIA metal, in a matrix, wherein the group VIIIA metal is present in an amount such that a ratio of gram atom mole of Group VIIIA metal:mole of framework aluminum of said large pore zeolite is less than 2; wherein the Group VIA metal is present in an amount ranging from 0.5 to 25 percent of the catalyst; and wherein the large pore size zeolite comprises 5 to 80 weight percent of the catalyst system.

39. The process as claimed in claim 38 in which the ratio of gram atom mole of Group VIIIA metal:mole of framework aluminum is 0.1 to 0.8.

40. The process as claimed in claim 38 in which the ratio of gram atom mole of Group VIIIA metal:mole of framework aluminum is 0.25 to 0.5.

41. The process as claimed in claim 38 in which the large pore size zeolite has a Constraint Index of less than 2.

42. The process as claimed in claim 38 in which the large pore size zeolite has the topology of a faujasite zeolite.

43. The process as claimed in claim 38 in which the large pore size zeolite has the topology of USY, REY or ZSM-20.

44. The process as claimed in claim 38 in which the large pore size zeolite has the topology of zeolite beta.

45. The process as claimed in claim 38 in which the intermediate pore size zeolite has a Constraint Index ranging from 2 to 12.

46. The process as claimed in claim 38 in which the intermediate pore size zeolite has the topology of ZSM-5.

47. The process as claimed in claim 38 in which the intermediate pore size zeolite is in the aluminosilicate form.

48. The process as claimed in claim 28 in which the large pore size zeolite is in the aluminosilicate form.

49. The process as claimed in claim 28 which is carried out in two stages with an interstage separation of light ends and heavy ends with the heavy ends fed to the octane restoring reaction zone.

50. The process as claimed in claim 28 which is carried out in cascade mode with the entire effluent from the hydrodesulfurization zone passed to the octane restoring reaction zone.

* * * * *